US006640154B2

(12) United States Patent
Breuer

(10) Patent No.: US 6,640,154 B2
(45) Date of Patent: Oct. 28, 2003

(54) DEVICE FOR DETERMINING ADJUSTMENT VALUES FOR THE PRE-DRAFT OF A SLIVER

(75) Inventor: Achim Breuer, Aachen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/319,559

(22) Filed: Dec. 16, 2002

(65) Prior Publication Data

US 2003/0114951 A1 Jun. 19, 2003

(30) Foreign Application Priority Data

Dec. 19, 2001 (DE) ..... 101 62 314

(51) Int. Cl.[7] ..... D01H 5/42
(52) U.S. Cl. ..... 700/142; 19/240
(58) Field of Search ..... 700/142, 143, 700/130; 19/239, 240, 236, 237, 238, 258, 150, 157, 260

(56) References Cited

U.S. PATENT DOCUMENTS 4,646,391 A * 3/1987 Wolf ..... 19/239 X
6,453,514 B1 * 9/2002 Breuer et al. ..... 19/239

FOREIGN PATENT DOCUMENTS

DE 33 15 247 A1 10/1984
DE 41 13 565 C2 * 10/1992 ..... 19/239
DE 199 06 139 A1 8/2000

OTHER PUBLICATIONS

Wegener, Walter, Bechlenberg, Heinz: Prüfgerät zur fortlaufenden Ermittlung von Verzugskräften. In: Textil–Praxis, 1960, Juli, S. 693–697.

* cited by examiner

*Primary Examiner*—Peter Nerbun
(74) *Attorney, Agent, or Firm*—Venable, LLP; Robert Kinberg; Stuart I. Smith

(57) ABSTRACT

A device is provided for determining and optimizing a pre-draft value on a draw unit for slivers. The draw unit has a feed roll pair, a center roll pair and a delivery roll pair, a pre-draft zone between the feed roll pair and the center roll pair, and a main draft zone between the center roll pair and the delivery roll pair. The device has a center roll drive motor for driving a lower roll of the center roll pair, a sensor for measuring values of a variable indicative of draft forces at the center roll drive motor, and means for controlling the drive motor in accordance with a function defining a relationship between the measured value and the pre-draft value. The function indicates an optimum region having at least one of an increase end point and an increase end region, the optimum region providing a parameter that is usable for optimizing the pre-draft value for the draw unit. A speed of the center roll drive motor is controlled to adjust a ratio of circumferential speeds of the center roll pair to the feed roll pair in order to change the pre-draft value.

20 Claims, 3 Drawing Sheets

DEVICE FOR DETERMINING ADJUSTMENT VALUES FOR THE PRE-DRAFT OF A SLIVER

CROSS-REFERENCE TO RELATED APPLICATION

This application claims priority to German Patent Application No. 101 62 314.3, filed Dec. 19, 2001, the disclosure of which is incorporated herein by reference.

BACKGROUND OF THE INVENTION

The invention relates to a device on a draw unit for slivers, for example a draw frame, for determining adjustment values for the pre-draft, wherein a ratio of the circumferential speeds of center rolls and feed rolls of the draw unit can be changed in order to change the draft and wherein measured values can be recorded for a variable characterizing the draft forces in the main draft and/or pre-draft zones.

In such draw units, the pre-draft and main draft are sliver stretching operations in which the fibers of the slivers are more linearly oriented by stretching the slivers.

A known device is provided with a pressure bar for deflecting the sliver bundle in a pre-draft zone. A minimum displacement sensing element is assigned to the pressure bar and functions to generate a signal depending on the pressure exerted by the sliver bundle onto the pressure bar. The draft force is derived from the pressure exerted on the sliver bundle.

SUMMARY OF THE INVENTION

It is an object of the invention to create a draw unit of the aforementioned type for further improving, in particular, the adaptation of the draw unit to each assortment change and/or for quality changes in the produced fiber structure(s).

This and other objects of the invention are achieved by a device for determining and optimizing a pre-draft value on a draw unit for slivers. The draw unit has a feed roll pair, a center roll pair and a delivery roll pair, a pre-draft zone between the feed roll pair and the center roll pair, and a main draft zone between the center roll pair and the delivery roll pair. The device has a center roll drive motor for driving a lower roll of the center roll pair, a sensor for measuring values of a variable indicative of draft forces at the center roll drive motor, and means for controlling the drive motor in accordance with a function defining a relationship between the measured value and the pre-draft value. The function indicates an optimum region having at least one of an increase end point and an increase end region, the optimum region providing a parameter that is usable for optimizing the pre-draft value for the draw unit. A speed of the center roll drive motor is controlled to adjust a ratio of circumferential speeds of the center roll pair to the feed roll pair in order to change the pre-draft value.

A ratio of circumferential speeds of bottom center rolls to bottom feed rolls of the draw unit can be changed to change the draft (sliver stretching). Measuring values can be recorded for a variable characterizing the draft forces in the pre-draft zone and/or the main draft zone.

The measures according to the invention improve the adjustment of the draw unit considerably. Electrical signals from sensors permit an easy detection of undesirable deviations from the desired variables, for example machine-related and/or fiber-technological values, for each assortment change and/or during quality changes in the produced structure. In the process, the type and degree of the deviation is detected.

Undesirable deviations in the operation can be detected and used by the operators to adapt the draw unit by, for example, changing the nip line distances and/or the drafts (sliver stretching). According to the invention, a mathematical evaluation and a corresponding adaptation of the draw unit based on the evaluation results are possible. The evaluation can be carried out either by the operating personnel or can be carried out automatically by a computer together with the auto-leveler draw frame.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
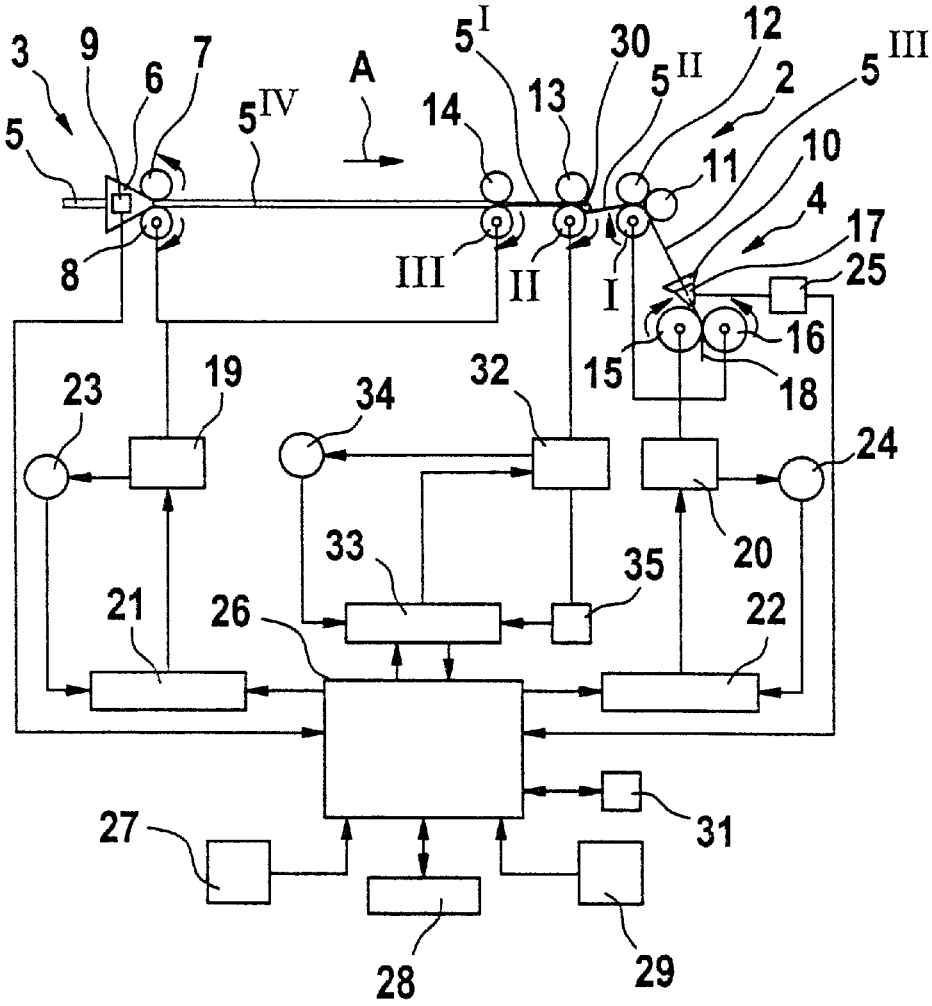
FIG. 1 is a schematic side elevation view of an auto-leveler draw frame according to the invention.

FIG. 1 shows a draw frame, for example a draw frame model HSR by the company Trützschler in M önchengladbach, Germany, comprising a draw unit 2 with a draw unit feed 3 installed upstream and a draw unit delivery 4 installed downstream. Slivers 5 coming from cans (not shown) enter a sliver guide 6 and are transported past a sensor 9 while being pulled by withdrawing rolls 7, 8. The draw unit 2 is configured as a 4-over-3 draw unit, meaning it has three bottom rolls I, II, III (I being the bottom delivery roll on the output side; II being the bottom center roll; III being the bottom feed roll) and four top rolls 11, 12, 13, 14.

The drafting of the sliver bundle $\mathbf{5}^{IV}$, consisting of several slivers 5, takes place in the draw unit 2. The drafting consists of a pre-draft and a main draft. The roll pairs 14/III and 13/II form the pre-draft zone and the roll pairs 13/II and 11, 12/I form the main draft zone. The sliver bundle 5' is drawn (stretched) in the pre-draft zone and the sliver bundle 5" is drawn (stretched) in the main draft zone. The drafted slivers 5'" reach a sliver guide 10 in the draw frame delivery side 4 and are pulled by means of withdrawing rolls 15, 16 through a sliver trumpet 17 where they are gathered to form a sliver 18 that is subsequently deposited in cans. The arrow A shows the operating direction.

The withdrawing rolls 7, 8 and the bottom feed roll III, for example connected mechanically via toothed belts, are driven by a servomotor 19. A desired value can be specified for the rotational speed of the servomotor 19. The top roll 14 rotates along with bottom feed roll III. The center bottom roll II is driven by a controlled center motor 32. The top roll 13 rotates along with center bottom roll II. A main motor 20 drives the bottom roll I on the delivery side as well as the withdrawing rolls 15, 16. The servomotor 19, the drive motor 32 and the main motor 20 respectively are provided with controllers 21, 33 and 22. The controllers 21, 33 and 22 are respectively connected to electrical connecting terminals for the motors 19, 32 and 20. Speed control respectively occurs via a closed control loop, wherein the servomotor 19 is assigned a tachometer generator 23, the central motor 32 is assigned a tachometer generator 34 and the main motor 20 is assigned a tachometer generator 24. A variable that is proportional to the mass, for example the cross section of the fed-in slivers 5, is measured at the draw frame feed 3 with the feed side sensor 9. An example of such a sensor is disclosed in German Patent A-44 04 326. The cross section (thickness) of the exiting sliver 18 is measured at the draw frame delivery side 4 with a delivery side sensor 25 that is, for example, associated with the sliver trumpet 17. An example of such a sensor is shown in German Patent A-195 37 983.

A central computer unit 26, for example a microcomputer with microprocessor, transmits a desired adjustment variable for the servomotor 19 to the controller 21. The measuring variables from both sensors 9 and 25 are transmitted during the drafting operation to the central computer unit 26. The desired value for the servomotor 19 is determined in the central computer 26 from the variables measured by the feed side sensor 9 and the desired value for the cross section of the exiting sliver 18. The variables measured by the sensor 25 on the delivery side are used to monitor the exiting slivers 18. An online determination of the optimum pre-draft is then carried out. Fluctuations in the cross section of the fed-in slivers 5 can be compensated for with the aid of this control system and the slivers can be made more uniform through corresponding adjustments of the pre-draft operation. A monitor 27, an interface 28, an input device 29 and a pressure bar 30 are also provided.

A sensor 35, which advantageously forms a component of the drive module for the actuation unit 33, is provided for measuring an electrical current consumption at the center motor 32. The sensor 35 is connected, for example, to the electrical connecting terminals of the center motor 32. The values measured with the sensor 35 are supplied via the controller 33 to a memory 31 in the central computer unit 26.

Figure 2:
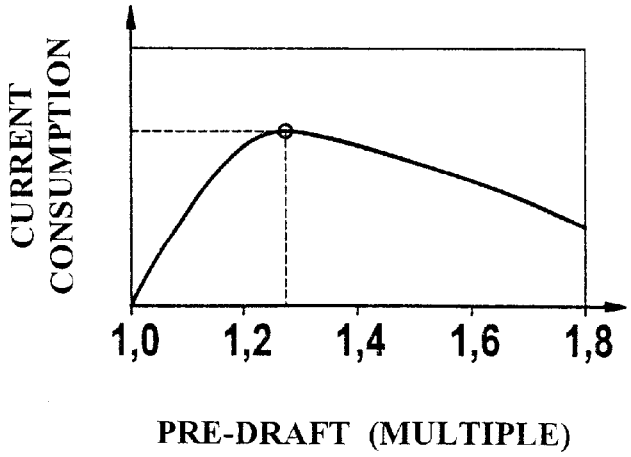
FIG. 2 is a graph showing the electrical current consumption at the center roll as a function of the pre-draft level (pre-draft stretching ratio)

Embodiments of the invention make it possible to directly determine adjustment values for the pre-draft. With the aid of the sliver bundle 5', a plurality of values measured for the current consumption are recorded via the sensor 35. From these values, the central computer unit 26 determines the function (an example of which is shown in FIG. 2) between the values measured for the current consumption (a variable indicative of the draft force) and the pre-draft values. The optimum pre-draft level is then determined and adjusted on the draw frame. Because the optimum pre-draft level can be determined online at the draw frame, the crimping of the sliver on the draw frame can be described realistically. These measures represent an important step toward a self-optimizing draw frame. The pre-draft is designed to correct crimping in the fibers. At a specific point in the pre-draft, the crimping is thus removed and the fibers straightened out. Below and above this optimum level in the pre-draft, the quality becomes poorer. For that reason, the optimum pre-draft level of the sliver on the draw frame can be described with a measuring variable.

If crimped fibers are fed from the pre-draft zone into the main draft zone of the draw frame, the draft force in the main draft is different than if completely stretched fibers are fed from the pre-draft zone into the main draft zone. This change in the draft force can be detected, so that the optimum draft level can be determined. The optimum pre-draft level thus corresponds to the point in the pre-draft zone where the fibers are just drafted completely.

Figure 3:
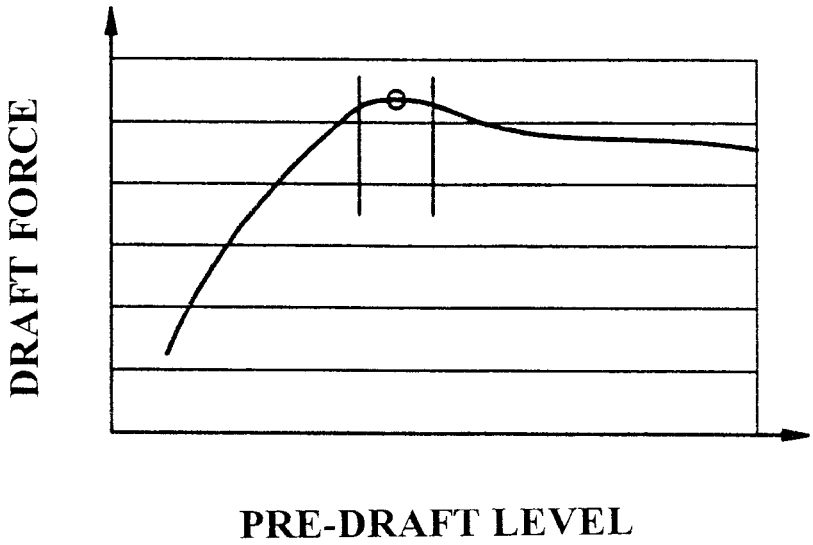
FIG. 3 is a graph showing the draft force as a function of the pre-draft level, with an optimization region.

FIG. 3 schematically shows a function between the draft force and the pre-draft level. FIG. 3 shows a reversing point at which the draft force peaks and begins to decline as the pre-draft level increases. This point is defined as the increase end point. A region around the increase end point is also shown. The increase end point represents the optimum pre-draft level. The draft force can be determined directly or indirectly via a variable that characterizes the draft force, for example the electrical current consumption at the center motor.

Figure 4:
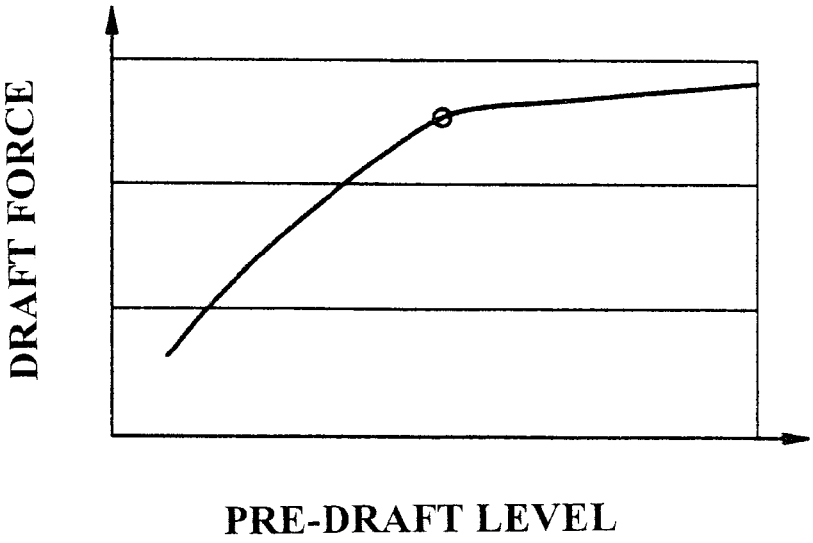
FIG. 4 is a graph showing the draft force as a function of the pre-draft level and an optimization point.

FIG. 4 shows a different function between the draft force and the pre-draft level. In FIG. 4, the increase end point is defined as a point at which the rate of increase of the draft force sharply decreases (the slope of the curve sharply decreases). The point represents the optimum pre-draft level. The point is a pronounced point at which the increase no longer continues or is reduced significantly. The point can be determined by computing and/or displaying as an image the measured values for the curve in the form of two approximately straight lines and by using the intersection point of the two straight lines.

Figure 5:
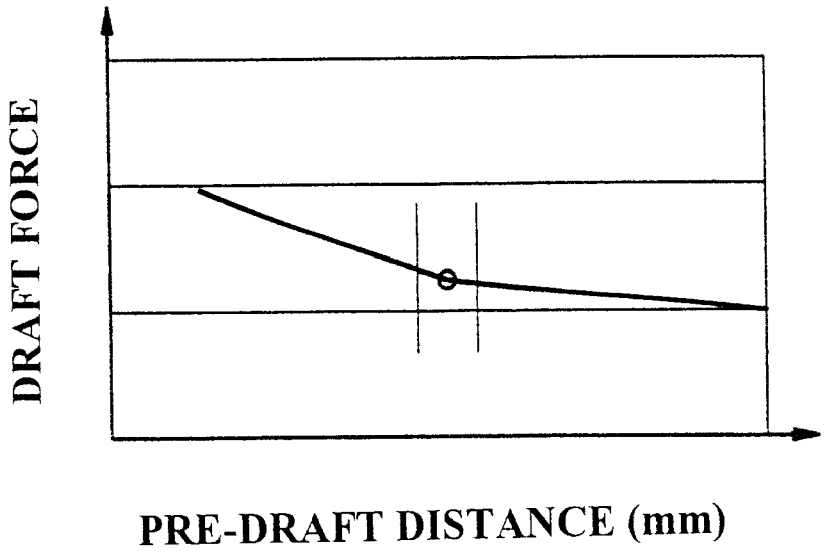
FIG. 5 is a graph showing draft force as a function of the pre-draft distances with an optimization area.
Figure 6:
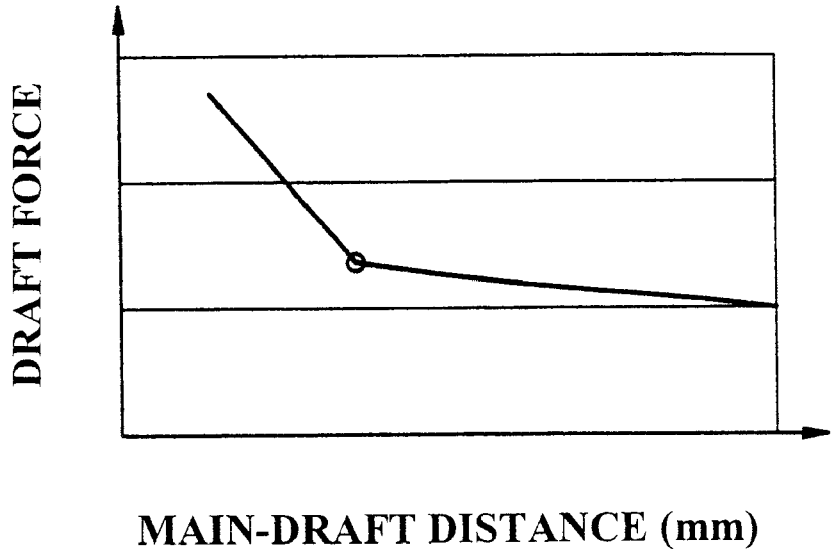
FIG. 6 is a graph showing draft force as a function of the main draft distances with an optimization point.

The device according to the invention can also be used to adjust an optimum pre-draft distance and a main draft distance (nip line distance). FIG. 5 schematically shows a function between the draft force and the pre-draft distance. In FIG. 5, a point is shown at which the rate of decrease of the draft force decreases (the curve becomes less steep). A region around this point is also shown. FIG. 6 schematically shows a function between the draft force and the main draft distance. In FIG. 6, a point is shown at which the rate of decrease of the draft force decreases (the curve becomes less steep).

The invention was illustrated using an example of a draw unit for a draw frame. However, the invention includes all draw units on spinning machines, for example ring spinning machines, combing machines, carding machines, and the like.

The invention can be used with a controlled or uncontrolled draw unit.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A device for determining and optimizing a pre-draft value on a draw unit for slivers, the draw unit having a feed roll pair, a center roll pair and a delivery roll pair, a pre-draft zone between the feed roll pair and the center roll pair, and a main draft zone between the center roll pair and the delivery roll pair, the device comprising:

a center roll drive motor for driving a lower roll of the center roll pair;

a sensor for measuring values of a variable indicative of draft forces at the center roll drive motor; and means for controlling the drive motor in accordance with a function defining a relationship between the measured value and the pre-draft value, the function indicating an optimum region having at least one of an increase end point and an increase end region, the optimum region providing a parameter that is usable for optimizing the pre-draft value for the draw unit, wherein a speed of the center roll drive motor is controlled to adjust a ratio of circumferential speeds of the center roll pair to the feed roll pair in order to change the pre-draft value.

2. The device according to claim 1, wherein a driving force for the center roll drive motor is measured by the sensor.

3. The device according to claim 2, wherein the driving force is measured by measuring the torque at one roll of the center roll pair.

4. The device according to claim 2, wherein the driving force is measured by measuring the actual current consumption of the drive motor.

5. The device according to claim 2, wherein the driving force is measured by measuring the phase displacement.

6. The device according to claim 2, wherein the driving force is measured by measuring a change in speed of the center roll pair.

7. The device according to claim 1, further comprising separate drive motors for each roll pair of the feed roll pair, the center roll pair and the delivery roll pair.

8. The device according to claim 1, wherein the center roll drive motor drives only the lower roll of the center roll pair, and the center roll drive motor is controllable.

9. The device according to claim 1, wherein the draft force increases until the optimum region is reached.

10. The device according to claim 1, wherein the measured values are converted to electronic signals.

11. The device according to claim 1, wherein the measured values are assigned to specific pre-drafts.

12. The device according to claim 11, wherein the controlling means comprises a processor, and the measured values are mathematically assigned to specific pre-drafts by the processor.

13. The device according to claim 1, further comprising a data table containing an assignment of the measured values to specific pre-draft values.

14. The device according to claim 1, wherein an optimum pre-draft value is determined automatically.

15. The device according to claim 1, wherein an optimum pre-draft value is adjusted automatically.

16. The device according to claim 1, wherein the controlling means comprises a processor, and the sensor is connected to the processor.

17. The device according to claim 16, wherein the center roll drive motor is connected to the processor.

18. The device according to claim 17, wherein an optimum adjustment of the draw unit is provided to the center roll drive motor.

19. The device according to claim 1, wherein the variable indicative of the draft forces is measured at the delivery roll pair in the pre-draft zone.

20. The device according to claim 1, wherein the variable indicative of the draft forces is measured at the feed roll pair in the main draft zone.

* * * * *